US007004264B2

(12) United States Patent
Simpson et al.

(10) Patent No.: US 7,004,264 B2
(45) Date of Patent: Feb. 28, 2006

(54) BORE LINING AND DRILLING

(75) Inventors: Neil Andrew Abercrombie Simpson, Portlethen (GB); Simon John Harrall, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/388,873

(22) Filed: Mar. 14, 2003

(65) Prior Publication Data

US 2003/0217865 A1 Nov. 27, 2003

(30) Foreign Application Priority Data

Mar. 16, 2002 (GB) ..... 0206227

(51) Int. Cl.
*E21B 7/20* (2006.01)
*E21B 23/00* (2006.01)
*E21B 29/10* (2006.01)

(52) U.S. Cl. ..... 175/57; 175/171; 175/263; 166/277; 166/207

(58) Field of Classification Search ..... 166/277, 166/378, 380, 381, 382, 384, 387, 206, 207, 166/208, 242.2, 242.6; 175/57, 22, 23, 53, 175/171, 257, 258, 263, 290
See application file for complete search history.

(56) References Cited

U.S. PATENT DOCUMENTS

| | | | |
|---|---|---|---|
| 1,185,582 | A | 5/1916 | Bignell |
| 1,301,285 | A | 4/1919 | Leonard |
| 1,342,424 | A | 6/1920 | Cotten |
| 1,842,638 | A | 1/1932 | Wigle |
| 1,860,218 | A | 10/1932 | Simmons |
| 1,917,135 | A | 7/1933 | Littell |
| 1,981,525 | A | 11/1934 | Price ..... 166/4 |
| 2,017,451 | A | 10/1935 | Wickersham |
| 2,049,450 | A | 8/1936 | Johnson |
| 2,060,352 | A | 11/1936 | Stokes |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,610,690 | A | 9/1952 | Beatty |

(Continued)

FOREIGN PATENT DOCUMENTS

CA 2 335 192 11/2001

(Continued)

OTHER PUBLICATIONS

European Search Report, dated Jun. 12, 2002 for GB 0206227.1.

(Continued)

*Primary Examiner*—Jennifer H Gay
(74) *Attorney, Agent, or Firm*—Patterson & Sheridan LLP

(57) ABSTRACT

A method of lining and drilling a bore (10) comprises the steps of mounting a first section of bore-lining tubing (20) on the lower end portion of a drill string (18). The method also includes running the drill string and tubing into a bore having an unlined section and an existing tubing lined section, locating the first tubing section (20) in the unlined section, uncoupling the first tubing section (20) from the drill string (18), and drilling the bore beyond the first tubing section.

40 Claims, 1 Drawing Sheet

U.S. PATENT DOCUMENTS

| | | | | |
|---|---|---|---|---|
| 2,621,742 | A | 12/1952 | Brown | |
| 2,627,891 | A | 2/1953 | Clark | |
| 2,641,444 | A | 6/1953 | Moon | |
| 2,650,314 | A | 8/1953 | Hennigh et al. | |
| 2,663,073 | A | 12/1953 | Bieber et al. | |
| 2,668,689 | A | 2/1954 | Cormany | |
| 2,692,059 | A | 10/1954 | Bolling, Jr. | |
| 2,720,267 | A | 10/1955 | Brown | |
| 2,738,011 | A | 3/1956 | Mabry | |
| 2,741,907 | A | 4/1956 | Genender et al. | |
| 2,743,087 | A | 4/1956 | Layne et al. | |
| 2,743,495 | A | 5/1956 | Eklund | |
| 2,764,329 | A | 9/1956 | Hampton | |
| 2,765,146 | A | 10/1956 | Williams | |
| 2,805,043 | A | 9/1957 | Williams | |
| 2,978,047 | A * | 4/1961 | De Vaan | 175/258 |
| 3,006,415 | A | 10/1961 | Burns et al. | |
| 3,041,901 | A | 7/1962 | Knights | |
| 3,054,100 | A | 9/1962 | Jones | |
| 3,087,546 | A | 4/1963 | Wooley | |
| 3,090,031 | A | 5/1963 | Lord | |
| 3,102,599 | A | 9/1963 | Hillburn | 175/72 |
| 3,111,179 | A | 11/1963 | Albers et al. | |
| 3,117,636 | A | 1/1964 | Wilcox et al. | |
| 3,122,811 | A | 3/1964 | Gilreath | |
| 3,123,160 | A | 3/1964 | Kammerer | |
| 3,124,023 | A | 3/1964 | Marquis et al. | |
| 3,131,769 | A | 5/1964 | Rochemont | |
| 3,159,219 | A | 12/1964 | Scott | |
| 3,169,592 | A | 2/1965 | Kammerer | |
| 3,191,677 | A | 6/1965 | Kinley | |
| 3,191,680 | A | 6/1965 | Vincent | |
| 3,193,116 | A | 7/1965 | Kenneday et al. | |
| 3,353,599 | A | 11/1967 | Shift | |
| 3,380,528 | A | 4/1968 | Timmons | |
| 3,387,693 | A | 6/1968 | Hoever | |
| 3,392,609 | A | 7/1968 | Bartos | |
| 3,419,079 | A | 12/1968 | Current | |
| 3,489,220 | A | 1/1970 | Kinley | |
| 3,518,903 | A | 7/1970 | Ham et al. | |
| 3,548,936 | A | 12/1970 | Kilgore et al. | |
| 3,550,684 | A | 12/1970 | Cubberly, Jr. | |
| 3,552,507 | A | 1/1971 | Brown | |
| 3,552,508 | A | 1/1971 | Brown | |
| 3,552,509 | A | 1/1971 | Brown | |
| 3,552,510 | A | 1/1971 | Brown | |
| 3,552,848 | A | 1/1971 | Van Wagner | |
| 3,559,739 | A | 2/1971 | Hutchison | |
| 3,566,505 | A | 3/1971 | Martin | |
| 3,570,598 | A | 3/1971 | Johnson | |
| 3,575,245 | A | 4/1971 | Cordary et al. | |
| 3,602,302 | A | 8/1971 | Kluth | |
| 3,603,411 | A * | 9/1971 | Link | 175/259 |
| 3,603,412 | A | 9/1971 | Kammerer, Jr. et al. | |
| 3,603,413 | A | 9/1971 | Grill et al. | |
| 3,606,664 | A | 9/1971 | Weiner | |
| 3,624,760 | A | 11/1971 | Bodine | |
| 3,635,105 | A | 1/1972 | Dickmann et al. | |
| 3,656,564 | A | 4/1972 | Brown | |
| 3,669,190 | A | 6/1972 | Sizer et al. | |
| 3,680,412 | A | 8/1972 | Mayer et al. | |
| 3,691,624 | A | 9/1972 | Kinley | |
| 3,691,825 | A | 9/1972 | Dyer | |
| 3,692,126 | A | 9/1972 | Rushing et al. | |
| 3,696,332 | A | 10/1972 | Dickson, Jr. et al. | |
| 3,700,048 | A | 10/1972 | Desmoulins | |
| 3,729,057 | A | 4/1973 | Werner | |
| 3,747,675 | A | 7/1973 | Brown | |
| 3,760,894 | A | 9/1973 | Pitifer | |
| 3,776,320 | A | 12/1973 | Brown | |
| 3,776,991 | A | 12/1973 | Marcus | |
| 3,785,193 | A | 1/1974 | Kinley et al. | |
| 3,808,916 | A | 5/1974 | Porter et al. | |
| 3,838,613 | A | 10/1974 | Wilms | |
| 3,840,128 | A | 10/1974 | Swoboda, Jr. et al. | |
| 3,848,684 | A | 11/1974 | West | |
| 3,857,450 | A | 12/1974 | Guier | |
| 3,870,114 | A | 3/1975 | Pulk et al. | |
| 3,881,375 | A | 5/1975 | Kelly | |
| 3,885,679 | A | 5/1975 | Swoboda, Jr. et al. | |
| 3,901,331 | A | 8/1975 | Djurovic | |
| 3,913,687 | A | 10/1975 | Gyongyosi et al. | |
| 3,934,660 | A | 1/1976 | Nelson | 175/102 |
| 3,945,444 | A | 3/1976 | Knudson | |
| 3,964,556 | A | 6/1976 | Gearhart et al. | |
| 3,980,143 | A | 9/1976 | Swartz et al. | |
| 4,049,066 | A | 9/1977 | Richey | |
| 4,054,332 | A | 10/1977 | Bryan, Jr. | |
| 4,054,426 | A | 10/1977 | White | |
| 4,064,939 | A | 12/1977 | Marquis | |
| 4,077,525 | A | 3/1978 | Callegari et al. | |
| 4,082,144 | A | 4/1978 | Marquis | |
| 4,083,405 | A | 4/1978 | Shirley | 166/285 |
| 4,085,808 | A | 4/1978 | Kling | |
| 4,095,865 | A | 6/1978 | Denison et al. | |
| 4,100,968 | A | 7/1978 | Delano | |
| 4,100,981 | A | 7/1978 | Chaffin | |
| 4,127,927 | A | 12/1978 | Hauk et al. | |
| 4,133,396 | A | 1/1979 | Tschirky | |
| 4,142,739 | A | 3/1979 | Billingsley | |
| 4,173,457 | A | 11/1979 | Smith | |
| 4,175,619 | A | 11/1979 | Davis | |
| 4,186,628 | A | 2/1980 | Bonnice | |
| 4,189,185 | A | 2/1980 | Kammerer, Jr. et al. | |
| 4,194,383 | A | 3/1980 | Huzyak | |
| 4,221,269 | A | 9/1980 | Hudson | |
| 4,227,197 | A | 10/1980 | Nimmo et al. | |
| 4,241,878 | A | 12/1980 | Underwood | |
| 4,257,442 | A | 3/1981 | Claycomb | |
| 4,262,693 | A | 4/1981 | Giebeler | |
| 4,274,777 | A | 6/1981 | Scaggs | |
| 4,274,778 | A | 6/1981 | Putnam et al. | |
| 4,277,197 | A | 7/1981 | Bingham | |
| 4,280,380 | A | 7/1981 | Eshghy | |
| 4,281,722 | A | 8/1981 | Tucker et al. | |
| 4,287,949 | A | 9/1981 | Lindsey, Jr. | |
| 4,311,195 | A | 1/1982 | Mullins, II | |
| 4,315,553 | A | 2/1982 | Stallings | |
| 4,320,915 | A | 3/1982 | Abbott et al. | |
| 4,336,415 | A | 6/1982 | Walling | |
| 4,384,627 | A | 5/1983 | Ramirez-Jauregui | |
| 4,392,534 | A | 7/1983 | Miida | |
| 4,396,076 | A | 8/1983 | Inoue | |
| 4,396,077 | A | 8/1983 | Radtke | |
| 4,407,378 | A | 10/1983 | Thomas | |
| 4,408,669 | A | 10/1983 | Wiredal | |
| 4,413,682 | A | 11/1983 | Callihan et al. | |
| 4,427,063 | A | 1/1984 | Skinner | |
| 4,437,363 | A | 3/1984 | Haynes | |
| 4,440,220 | A | 4/1984 | McArthur | |
| 4,445,734 | A | 5/1984 | Cunningham | |
| 4,446,745 | A | 5/1984 | Stone et al. | |
| 4,449,596 | A | 5/1984 | Boyadjieff | |
| 4,460,053 | A | 7/1984 | Jurgens et al. | |
| 4,463,814 | A | 8/1984 | Horstmeyer et al. | |
| 4,466,498 | A | 8/1984 | Bardwell | |
| 4,470,470 | A | 9/1984 | Takano | |
| 4,472,002 | A | 9/1984 | Beney et al. | |
| 4,474,243 | A | 10/1984 | Gaines | |
| 4,483,399 | A * | 11/1984 | Colgate | 166/308.1 |
| 4,489,793 | A | 12/1984 | Boren | |
| 4,494,424 | A | 1/1985 | Bates | |
| 4,515,045 | A | 5/1985 | Gnatchenko et al. | |
| 4,529,045 | A | 7/1985 | Boyadjieff et al. | |

4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson ..... 175/73
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,312 A 6/1987 Mosing et al.
4,681,158 A 7/1987 Pennison
4,683,962 A 8/1987 True
4,686,873 A 8/1987 Lang et al.
4,691,587 A 9/1987 Farrand et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,901,069 A 2/1990 Veneruso
4,904,119 A 2/1990 Legendre et al.
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,069,297 A 12/1991 Krueger
5,074,366 A 12/1991 Karlsson et al.
5,082,069 A 1/1992 Seiler et al.
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A * 12/1993 Leturno ..... 175/107
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,343,950 A 9/1994 Hale et al.
5,343,951 A 9/1994 Cowan et al.
5,348,095 A * 9/1994 Worrall et al. ..... 166/380
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,472,057 A * 12/1995 Winfree ..... 175/57
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.

5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,575,344 A 11/1996 Wireman
5,577,566 A 11/1996 Albright et al.
5,582,259 A 12/1996 Barr
5,584,343 A 12/1996 Coone
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,791,410 A 8/1998 Castille et al.
5,803,191 A 9/1998 Mackintosh
5,803,666 A 9/1998 Keller ..... 405/146
5,813,456 A 9/1998 Milner et al.
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,957,225 A * 9/1999 Sinor ..... 175/57
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,523 A * 1/2000 Campbell et al. ..... 166/277
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A * 6/2000 Cumming et al. ..... 166/381
6,079,498 A 6/2000 Lima et al.
6,079,509 A 6/2000 Bee et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,566 B1 4/2002 Hill
6,371,203 B1 * 4/2002 Frank et al. ..... 166/207
6,374,506 B1 4/2002 Schutte
6,374,924 B1 4/2002 Hanton et al.
6,378,627 B1 4/2002 Tubel et al.
6,378,630 B1 4/2002 Ritorto et al.
6,378,633 B1 4/2002 Moore
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 * 7/2002 Hahn et al. ..... 175/61
6,427,776 B1 8/2002 Hoffman et al.
6,429,784 B1 8/2002 Beique et al.
6,431,626 B1 8/2002 Bouligny

| | | | | |
|---|---|---|---|---|
| 6,433,241 | B1 | 8/2002 | Wu et al. | |
| 6,443,241 | B1 | 9/2002 | Juhasz et al. | |
| 6,443,247 | B1 | 9/2002 | Wardley | |
| 6,446,723 | B1 | 9/2002 | Ramons et al. | |
| 6,457,532 | B1 | 10/2002 | Simpson | 166/380 |
| 6,458,471 | B1 | 10/2002 | Lovato et al. | |
| 6,464,004 | B1 | 10/2002 | Crawford et al. | |
| 6,464,011 | B1 | 10/2002 | Tubel | |
| 6,484,818 | B1 | 11/2002 | Alft et al. | |
| 6,497,280 | B1 | 12/2002 | Beck et al. | |
| 6,527,047 | B1 | 3/2003 | Pietras | |
| 6,527,064 | B1 | 3/2003 | Hallundbaek | |
| 6,536,520 | B1 | 3/2003 | Snider et al. | |
| 6,536,522 | B1 | 3/2003 | Birckhead et al. | |
| 6,536,993 | B1 | 3/2003 | Strong et al. | |
| 6,538,576 | B1 | 3/2003 | Schultz et al. | |
| 6,543,552 | B1 * | 4/2003 | Metcalfe et al. | 175/57 |
| 6,547,017 | B1 | 4/2003 | Vail, III | |
| 6,554,064 | B1 | 4/2003 | Restarick et al. | |
| 6,585,040 | B1 | 7/2003 | Hanton et al. | |
| 6,591,471 | B1 | 7/2003 | Hollingsworth et al. | |
| 6,622,796 | B1 | 9/2003 | Pietras | |
| 6,634,430 | B1 | 10/2003 | Dawson et al. | |
| 6,648,075 | B1 | 11/2003 | Badrak et al. | |
| 6,651,737 | B1 | 11/2003 | Bouligny | |
| 6,655,460 | B1 | 12/2003 | Bailey et al. | |
| 6,666,274 | B1 | 12/2003 | Hughes | |
| 6,668,684 | B1 | 12/2003 | Allen et al. | |
| 6,668,937 | B1 | 12/2003 | Murray | |
| 6,688,394 | B1 | 2/2004 | Ayling | |
| 6,691,801 | B1 | 2/2004 | Juhasz et al. | |
| 6,698,595 | B1 | 3/2004 | Norell et al. | |
| 6,702,040 | B1 | 3/2004 | Sensenig | |
| 6,708,769 | B1 | 3/2004 | Haugen et al. | |
| 6,725,924 | B1 | 4/2004 | Davidson et al. | |
| 6,725,938 | B1 | 4/2004 | Pietras | |
| 6,742,596 | B1 | 6/2004 | Haugen | |
| 6,742,606 | B1 * | 6/2004 | Metcalfe et al. | 175/57 |
| 6,745,834 | B1 | 6/2004 | Davis et al. | |
| 6,752,211 | B1 | 6/2004 | Dewey et al. | |
| 6,840,322 | B1 | 1/2005 | Haynes | |
| 6,848,517 | B1 | 2/2005 | Wardley | |
| 6,854,533 | B1 | 2/2005 | Galloway | |
| 6,857,486 | B1 | 2/2005 | Chitwood et al. | |
| 6,857,487 | B1 | 2/2005 | Galloway | |
| 2001/0000101 | A1 | 4/2001 | Lovato et al. | |
| 2001/0002626 | A1 * | 6/2001 | Frank et al. | 175/57 |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0040787 | A1 | 4/2002 | Cook et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0079102 | A1 | 6/2002 | Dewey et al. | |
| 2002/0108748 | A1 | 8/2002 | Keyes | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0189806 | A1 | 12/2002 | Davidson et al. | |
| 2002/0189863 | A1 | 12/2002 | Wardley | |
| 2003/0029641 | A1 | 2/2003 | Meehan | |
| 2003/0034177 | A1 | 2/2003 | Chitwood et al. | |
| 2003/0056947 | A1 | 3/2003 | Cameron | |
| 2003/0056991 | A1 | 3/2003 | Hahn et al. | |
| 2003/0070841 | A1 | 4/2003 | Merecka et al. | |
| 2003/0071666 | A1 | 4/2003 | Bailey et al. | |
| 2003/0111267 | A1 | 6/2003 | Pia | |
| 2003/0132032 | A1 * | 7/2003 | Metcalfe et al. | 175/57 |
| 2003/0141111 | A1 | 7/2003 | Pia | |
| 2003/0146023 | A1 | 8/2003 | Pia | |
| 2003/0164250 | A1 | 9/2003 | Wardley | |
| 2003/0164251 | A1 | 9/2003 | Tulloch | |
| 2003/0173090 | A1 | 9/2003 | Cook et al. | |
| 2003/0213598 | A1 | 11/2003 | Hughes | |
| 2003/0217865 | A1 | 11/2003 | Simpson et al. | |
| 2003/0221519 | A1 | 12/2003 | Haugen et al. | |
| 2004/0000405 | A1 | 1/2004 | Fournier, Jr. et al. | |
| 2004/0003490 | A1 | 1/2004 | Shahin et al. | |
| 2004/0003944 | A1 | 1/2004 | Vincent et al. | |
| 2004/0011534 | A1 * | 1/2004 | Simonds et al. | 166/384 |
| 2004/0016575 | A1 | 1/2004 | Shahin et al. | |
| 2004/0060697 | A1 | 4/2004 | Tilton et al. | |
| 2004/0069500 | A1 | 4/2004 | Haugen | |
| 2004/0069501 | A1 | 4/2004 | Haugen et al. | |
| 2004/0079533 | A1 | 4/2004 | Buytaert et al. | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 * | 7/2004 | Gledhill et al. | 175/57 |
| 2004/0124015 | A1 | 7/2004 | Vaile, et al. | |
| 2004/0129456 | A1 | 7/2004 | Vail | |
| 2004/0134668 | A1 * | 7/2004 | Mackay | 166/380 |
| 2004/0140128 | A1 | 7/2004 | Vail | |
| 2004/0173358 | A1 | 9/2004 | Haugen | |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |

FOREIGN PATENT DOCUMENTS

| | | | |
|---|---|---|---|
| DE | 3 213 464 | | 10/1983 |
| DE | 3 523 221 | | 2/1987 |
| DE | 3 918 132 | | 12/1989 |
| DE | 4 133 802 | | 10/1992 |
| EP | 0 087 373 | | 8/1983 |
| EP | 0 162 000 | | 11/1985 |
| EP | 0 171 144 | | 2/1986 |
| EP | 0 235 105 | | 9/1987 |
| EP | 0 235 105 | A2 | 9/1987 |
| EP | 0 265 344 | | 4/1988 |
| EP | 0 265 344 | A1 | 4/1988 |
| EP | 0 285 386 | | 10/1988 |
| EP | 0 426 123 | | 5/1991 |
| EP | 0 462 618 | | 12/1991 |
| EP | 0 474 481 | | 3/1992 |
| EP | 0479583 | | 4/1992 |
| EP | 0 525 247 | | 2/1993 |
| EP | 0 554 568 | | 8/1993 |
| EP | 0 589 823 | | 3/1994 |
| EP | 0 659 975 | | 6/1995 |
| EP | 0 790 386 | | 8/1997 |
| EP | 0 881 354 | | 4/1998 |
| EP | 0 571 045 | | 8/1998 |
| EP | 0 961 007 | | 12/1999 |
| EP | 0 962 384 | | 12/1999 |
| EP | 1 006 260 | | 6/2000 |
| EP | 1 050 661 | | 11/2000 |
| EP | 1148206 | | 10/2001 |
| EP | 1 256 691 | | 11/2002 |
| FR | 2053088 | | 7/1970 |
| FR | 2741907 | | 6/1997 |

| | | |
|---|---|---|
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 201 912 | 9/1988 |
| GB | 2 216 926 | 10/1989 |
| GB | 2 216 926 A | 10/1989 |
| GB | 2 224 481 | 9/1990 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 333 542 | 7/1999 |
| GB | 2 335 217 | 9/1999 |
| GB | 2 348 223 | 9/2000 |
| GB | 2347445 | 9/2000 |
| GB | 2347445 A * | 9/2000 |
| GB | 2348223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 365 463 A | 2/2002 |
| GB | 2 372 765 | 9/2002 |
| GB | 2 382 361 | 5/2003 |
| GB | 2381809 | 5/2003 |
| RU | 1618870 | 1/1991 |
| RU | 2 079 633 | 5/1997 |
| SU | 112631 | 1/1956 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11920 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/05483 | 2/2000 |
| WO | WO 00/08293 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/44601 | 6/2002 |
| WO | WO 02/081863 | 10/2002 |
| WO | WO 02/086287 | 10/2002 |
| WO | WO 03/074836 | 9/2003 |
| WO | WO 03/087525 | 10/2003 |

OTHER PUBLICATIONS

PCT Search Report, International Application No. PCT/GB 03/01103, dated Jul. 14, 2003.

Hahn, et al., "Simultaneous Drill and Case Technology—Case Histories, Status and Options for Further Development," Society of Petroleum Engineers, IADC/SPE Drilling Conference, New Orleans, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/795,129, filed Mar. 5, 2004.

U.S. Appl. No. 10/794,790, filed Mar. 5, 2004.

U.S. Appl. No. 10/162,302, filed Jun. 4, 2004.

Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093.
U.S. Appl. No. 10/189,570.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Papaer 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology, " SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 7446, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.

Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pps. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.

* cited by examiner

BORE LINING AND DRILLING

FIELD OF THE INVENTION

This invention relates to an apparatus and method for use in lining and drilling a bore.

BACKGROUND OF THE INVENTION

In the oil and gas exploration and production industry bores are drilled from surface to access subsurface hydrocarbon reservoirs. The bores are typically drilled in sections: a section of bore is drilled using drilling apparatus including a bit mounted on the end of a string; the drilling apparatus is pulled out of the bore; a section of bore-lining tubing is run into the "open" bore; and the tubing is then cemented or otherwise sealed in the bore by filling the annulus between the tubing and the bore wall with cement slurry. These drilling and lining steps are repeated until the bore is of the required length or depth. Clearly, this can be a time-consuming operation as to drill and line each bore section it is necessary to make up and then dismantle first a drill string and then a running string, both of which may be several thousand metres long.

Furthermore, with conventional bore-lining techniques, the outer diameter of each section of bore-lining tubing must be smaller than the inner diameter of the preceding tubing to enable the tubing to be run into the bore. Thus, a step-wise reduction in bore diameter occurs at the transition between each bore section. The reduction in available bore diameter limits the production capabilities of the well, restricts access to the well, and also requires the use of smaller diameter and thus generally less robust drilling apparatus in the lower portions of the well. A further disadvantage also arises in that the upper portions of the bore may have to be drilled to a relatively large diameter, in light of the numerous subsequent diameter reductions that must be accommodated, which increases drilling time and expense.

Some of these disadvantages may be overcome by the use of expandable bore lining tubing, which may be run in through a section of existing tubing and then expanded to a larger diameter. However, to preserve bore diameter it is important that the desired degree of overlap between adjacent sections is maintained. This may be problematic when, for example, it is not possible to run the tubing to the bottom of the bore. This may occur due to material gathering in the lower end of the bore, or the tubing encountering an unexpected bore diameter restriction.

Another proposal, as described in U.S. Pat. No. 6,457,532 and U.S. Ser. No. 09\469,643 the disclosures of which are incorporated herein by reference, is to form the lower end of the drill string of expandable tubing. Thus, if a problem formation is encountered in the course of a drilling operation, the tubing may be expanded without the delay that would be involved in pulling out the drilling apparatus and then running in and expanding a section of bore-lining tubing.

However, with this method, if a problem formation is encountered early in the drilling operation, only a short section of the expandable tubing is utilised to line open bore, and a significant portion of the tubing is located within the existing casing or liner and thus serves no useful purpose, and further restricts the available bore diameter. Alternatively, if no problems are encountered, the length of bore which can be lined is restricted by the length of the expandable tubing previously incorporated in the string.

Furthermore, the expandable tubing which forms the lower end of the drill string as proposed in PCT\GB99\04246 is likely to represent a compromise between the qualities and properties required to withstand the weight and torque which must be transmitted from surface via the tubing to the drill bit, to allow drilling fluid to be carried to the bit, to have sufficient abrasion resistance to avoid damage from contact with surrounding casing or bore wall, and to allow installation and expansion to create a safe and secure bore lining.

SUMMARY OF THE INVENTION

According to a first aspect of the present invention there is provided a method of lining and drilling a bore, the method comprising the steps:

- mounting a first section of bore-lining tubing on the lower end portion of a drill string;
- running the drill string and tubing into a bore having an unlined section and an existing tubing lined section;
- locating the first tubing section in the unlined section;
- uncoupling the first tubing section from the drill string; and
- drilling the bore beyond the first tubing section.

The invention also relates to an apparatus for implementing the method. Preferably, the first section of bore-lining tubing is expandable, but may alternatively be non-expandable.

The upper end of the first tubing section may overlap the lower end of the existing tubing, or may be spaced therefrom.

Preferably, a tubing expander is mounted on the string, and is operated to expand the first tubing section. Preferably, the tubing expander is a rotary expander, such as described in applicant's U.S. Pat. No. 6,457,532, the disclosure of which is incorporated herein by reference. Such an expander may operate to produce compressive yield in the tubing wall, the resulting thinning of the wall resulting in a corresponding increase in tubing.

Alternatively, or in addition, a different expansion mechanism may be utilised, such as an axially movable cone or swage, by means of applied internal pressure, or by a combination of two or more different expansion mechanisms, such as described in applicant's U.S. Pat. No. 6,712,151, the disclosure of which is incorporated herein by reference.

Preferably, a drill bit is mounted to the drill string. Most preferably, the bit is initially located within or above the bore-lining tubing. Preferably, the bit is configured to drill a larger diameter bore than the initial bit diameter, for example, the bit may be a bi-centre bit or an expandable bit, such that the bit may pass through the first tubing section and then be utilised to drill a bore of larger diameter than the internal diameter of the tubing section.

Preferably, the method includes providing a coupling, typically setting a hanger, to couple the upper end of the first tubing section to the lower end of the existing tubing. Preferably, the coupling is achieved by expanding the upper end of the first tubing into contact with the lower section of the existing tubing, which may also be subject to expansion. Alternatively, or in addition, the lower end of the existing tubing may be adapted to accommodate the expanded upper end of the first tubing by, for example, provision of a larger diameter bell-end or the like.

The first tubing section may be cemented or otherwise sealed in the bore, typically by injecting a slurry or other fluid form of settable material into the annulus between the tubing and the bore wall. If the tubing section is expanded, the expansion may be carried out before or after cementing.

The tubing section may be expanded before, during or after drilling the next bore section.

Following drilling of the next section, the drill string and drill bit may be pulled out of hole and the method repeated using a further tubing section of length corresponding to the unlined drilled bore section.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figures 1, 2, 3, 4, 5, 6, 7:
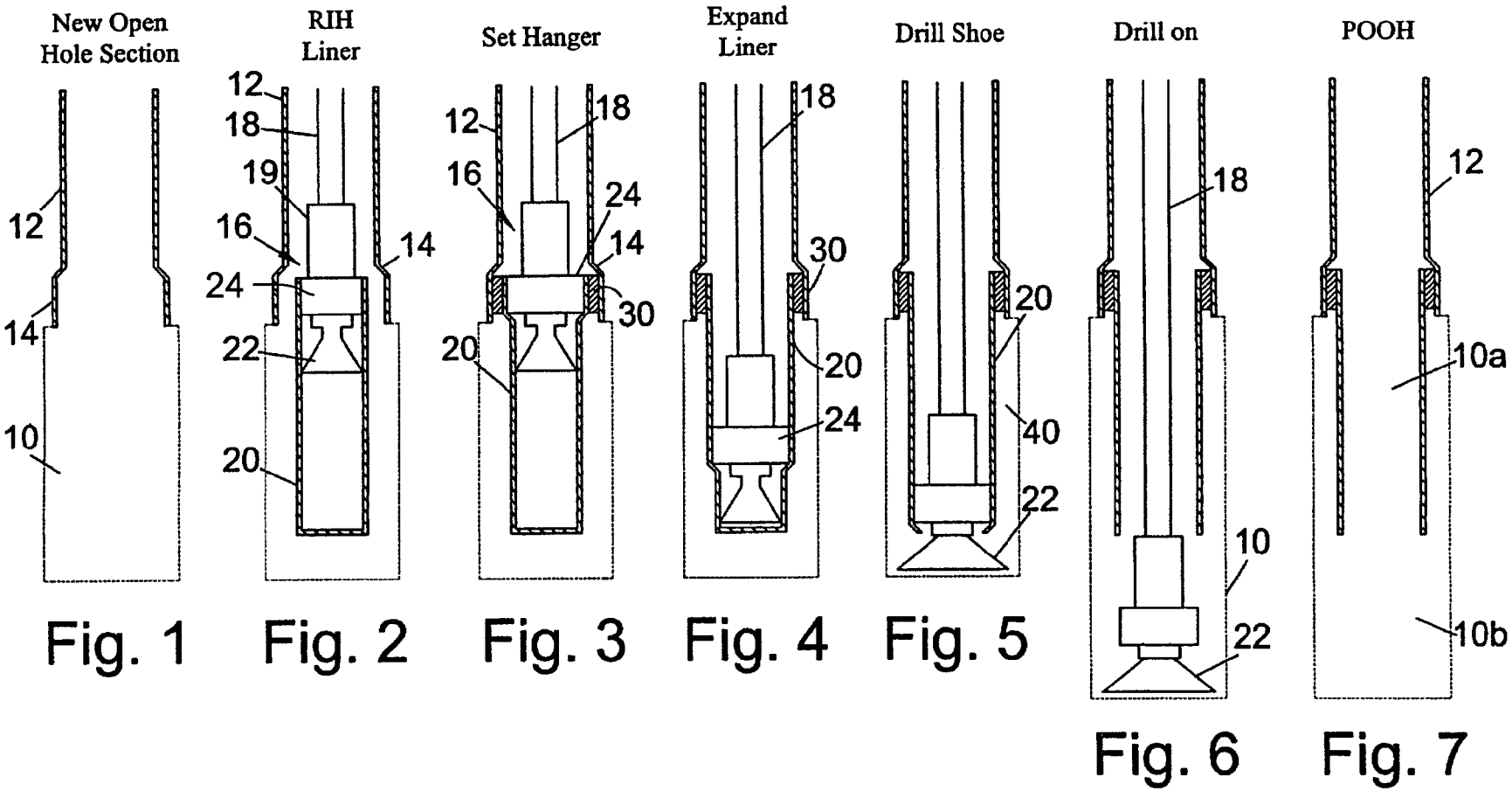
FIGS. 1 to 7 are schematic illustrations of steps in accordance with a preferred embodiment of the present invention.

The drawings illustrate stages in the lining and drilling of a bore 10, as may be used to access a subsurface hydrocarbon-bearing formation. FIG. 1 illustrates an existing bore 10 which is partially lined with casing 12, and the bore having been extended beyond the casing 12; as illustrated in FIG. 1, the lower section of the bore 10 is open, or unlined. It will be noted that the lower end of the casing 12 defines a bell-end 14 of larger diameter than the upper portion of the casing, the purpose of which will become apparent in due course.

FIG. 2 illustrates lining and drilling apparatus 16 in accordance with an embodiment of an aspect of the invention which has been run into the lower section of the bore 10 on the end of a drill string 18. The apparatus 16 comprises a body 19 which is coupled to the lower end of the drill string 18, a section of expandable tubing 20, an expandable drill bit 22 located within the upper end of the tubing 20, and shown in FIGS. 2 to 4 in unexpanded configuration, and a tubing expander 24 mounted on the body 19, the expander being initially dormant and providing support for the tubing 20.

The apparatus 16 is located in the bore 10 such that the upper end of the tubing 20 overlaps the lower end of the casing 12, and in particular is located within the casing bell-end 14. As illustrated in FIG. 3, the tubing expander 24 is then activated to expand the upper end of the tubing 20 into contact with the casing 12, to create a tubing hanger 30. The preferred expander 24 is a hydraulic fluid-activated rotary expander. Thus, supplying pressurised fluid to the expander 24, via the string 18, urges a set of expansion members radially outwards to deform the upper end of the tubing 20 and form the hanger 30. The string 18 is then rotated from surface, to rotate the apparatus 16, apart from the tubing 20 which is now coupled to the casing 12. The apparatus 16 is then also advanced axially through the tubing 20, enlarging the tubing internal diameter such that it corresponds substantially to the casing internal diameter, as illustrated in FIG. 4.

On reaching the lower end of the tubing 20, the drill bit 22 is positioned beyond the end of the tubing 20, and is then expanded to assume its larger diameter configuration, as illustrated in FIG. 5.

The expander 24 is then returned to the dormant configuration; the sequential activation of the expander 24 and drill bit 22 may be achieved by any appropriate means as will as be apparent to those of skill in the art, such as dropping balls or darts.

The drill string 18 is then rotated at an appropriate speed for drilling, and drilling fluid is circulated through the string 18 to the bit 22. By applying appropriate weight to the bit 22, the bore 10 is drilled beyond the end of the expanded tubing 20, as illustrated in FIG. 6. Once the bore 10 has been extended by the appropriate length, the drill bit 22 is reconfigured to its retracted form and the drilling apparatus 16 pulled out of hole, leaving a further section of cased hole 10*a*, and a further section of open hole 10*b*, ready for the lining and drilling process as described above to be repeated.

It will be apparent to those of skill in the art that the above-described method provides for the efficient lining and drilling of a bore, while avoiding the disadvantages of prior art proposals.

It will also be apparent to those of skill in the art that the above-described embodiment is merely exemplary of the present invention, and that various modifications and improvements may be made thereto without departing from the scope of the present invention. For example, in an alternative embodiment the drill bit may initially be mounted to or beyond the lower end of the tubing 20, and the lower end of the drill string adapted to latch with the bit to allow drilling to commence once the tubing 20 has been located in the bore.

In another embodiment, the tubing 20 is sealed in the bore 10 by, for example, circulating a cement slurry into the annulus 40 (FIG. 5) between the tubing and the bore wall before or after expansion of the tubing.

What is claimed is:

1. A method of lining and drilling a bore, the method comprising:

mounting a first tubing section on a drill string;

running the drill string and the first tubing section into a pre-existing bore having an unlined section and a lined section lined with an existing tubing;

locating at least part of the first tubing section in the unlined section;

lowering a drill bit through at least a portion of the first tubing section; and drilling the bore beyond the first tubing section.

2. The method of claim 1, further comprising locating the first tubing section relative to the existing tubing such that the first tubing section overlaps the existing tubing.

3. The method of claim 2, comprising locating the first tubing section such that an upper end of the first tubing section overlaps a lower end of the existing tubing.

4. The method of claim 1, further comprising expanding the first tubing section while lowering the drill bit.

5. The method of claim 4, comprising expanding the first tubing section at least in part by application of a mechanical expansion force.

6. The method of claim 5, comprising expanding the first tubing section by rotary expansion.

7. The method of claim 5, comprising expanding the first tubing section by advancing an expansion cone axially through the tubing.

8. The method of claim 4, further comprising mounting a tubing expander on the string, and operating the tubing expander to expand the first tubing section.

9. The method of claim 4, comprising expanding the first tubing section at least in part by application of fluid pressure force.

10. The method of claim 4, comprising expanding the first tubing section by a combination of mechanical and fluid pressure expansion forces.

11. The method of claim 1, further comprising mounting the drill bit on the drill string.

12. The method of claim 11, comprising initially locating the bit within the first tubing section.

13. The method of claim 11, comprising initially locating the bit above the first tubing section.

14. The method of claim 1, further comprising reconfiguring the bit to drill a bore of larger diameter than the internal diameter of the first tubing section.

15. The method of claim 1, further comprising setting a hanger to couple the first tubing section to the existing tubing.

16. The method of claim 1, comprising expanding the first tubing section into contact with the existing tubing.

17. The method of claim 16, further comprising expanding the existing tubing while expanding the first tubing section.

18. The method of claim 16, further comprising providing existing tubing with a larger diameter lower end to accommodate the expanded upper end of the first tubing section.

19. The method of claim 16, further comprising sealing the first tubing section in the bore.

20. The method of claim 19, further comprising cementing the first tubing section in the bore.

21. The method of claim 1, wherein, following drilling of a section of bore beyond the first tubing section, the drill string and drill bit are pulled out of the bore, and the method is then repeated using a further tubing section of length corresponding to the unlined bore section which has been drilled beyond the first tubing section.

22. The method of claim 1, wherein the first section of bore-lining tubing comprises an enclosed lower end.

23. The method of claim 22, further comprising drilling through the enclosed lower end.

24. The method of claim 1, wherein the tubing lined section includes an increased diameter portion.

25. The method of claim 1, wherein the first tubing section and the tubing lined section have a substantially equivalent inner diameter following the expanding.

26. The method of claim 1 further comprising initially locating the bit in an upper portion of the first tubing section.

27. A method of lining and drilling a bore, the method comprising:

mounting a bore-lining tubing on a drill string coupled to a drill bit;

running the drill string and tubing into a pre-existing bore having an unlined section;

locating at least part of the tubing in the unlined section;

exanding the tubing while lowering the drill bit through the tubing; and drilling the bore beyond the tubing.

28. An apparatus for use in lining and drilling a bore, the apparatus comprising:

a bore-lining tubing coupled to a drill string; and a drill bit coupled to the drill string, wherein the bit is initially located in an upper portion of the bore-lining tubing and adapted to pass through the tubing and then to be utilised to drill a bore.

29. The apparatus of claim 28, wherein the drill bit is adapted to drill a bore of larger diameter than the internal diameter of the tubing.

30. The apparatus of claim 28, wherein the tubing is expandable.

31. The apparatus of claim 28, further comprising a tubing expander coupled to the string, the expander being operable to expand the tubing.

32. The apparatus of claim 31, wherein the tubing expander is a rotary expander.

33. The apparatus of claim 31, wherein the tubing expander is a cone.

34. The apparatus of claim 28, further comprising a coupling adapted for coupling the tubing to tubing previously located in the bore.

35. The apparatus of claim 34, wherein the coupling is activated by expanding the tubing into contact with the tubing previously located in the bore.

36. The apparatus of claim 34, wherein the coupling is adapted for coupling an upper end of the tubing to a lower end of the tubing located in the bore.

37. A method of lining and drilling a bore, the method comprising:

mounting a first tubing section on a drill string;

mounting a drill bit on the drill string;

initially locating the bit above the first tubing section;

running the drill string and the first tubing section into a pre-existing bore having an unlined section and a lined section lined with an existing tubing;

locating at least part of the first tubing section in the unlined section; and drilling the bore beyond the first tubing section.

38. A method of lining and drilling a bore, the method comprising:

mounting a tubing on a drill string coupled to a drill bit;

initially locating the drill bit in an upper portion of the tubing;

running the drill string and the tubing into a bore having an unlined section and a lined section; and drilling the bore beyond the tubing.

39. The method of claim 38, further comprising coupling an expander to the drill bit.

40. The method of claim 38, further comprising expanding the tubing while lowering the drill bit along the tubing.

* * * * *